US006689037B2

(12) United States Patent
Waldeck et al.

(10) Patent No.: US 6,689,037 B2
(45) Date of Patent: Feb. 10, 2004

(54) MACHINE FOR THE LENGTHWISE TREATMENT OF WEBS OF CORRUGATED BOARD

(75) Inventors: Karl Waldeck, Etzenricht (DE); Karl Ruhland, Pfreimd (DE); Hermann Mensing, Weiherhammer (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 09/924,098

(22) Filed: Aug. 8, 2001

(65) Prior Publication Data

US 2002/0022562 A1 Feb. 21, 2002

(30) Foreign Application Priority Data

Aug. 8, 2000 (DE) ..... 100 38 511

(51) Int. Cl.[7] ..... B31B 1/16

(52) U.S. Cl. ..... 493/355; 83/499; 83/504; 83/508.3; 83/425.4; 74/89.23; 74/89.38

(58) Field of Search ..... 83/499, 504, 508.3, 83/425.4; 74/89.38, 89.28, 89.23; 493/355

(56) References Cited

U.S. PATENT DOCUMENTS 3,929,047 A * 12/1975 Brandl ..... 493/60
4,261,239 A * 4/1981 Toboshi et al. ..... 493/355
4,976,676 A 12/1990 Mensing
5,918,519 A * 7/1999 Schnabel et al. ..... 83/102
6,071,222 A * 6/2000 Schneider ..... 493/355
6,286,404 B1 * 9/2001 Miglietta ..... 83/498
6,386,057 B1 * 5/2002 Thomas et al. ..... 74/89.28

FOREIGN PATENT DOCUMENTS

DE 29 49 205 A1 12/1979
DE 3826993 C2 8/1988
EP 0 312 956 A2 10/1988

* cited by examiner

*Primary Examiner*—Rinaldi I. Rada
*Assistant Examiner*—Gloria R Weeks
(74) *Attorney, Agent, or Firm*—Browdy and Neimark

(57) ABSTRACT

On a machine frame, a machine for the lengthwise treatment of webs of corrugated board comprises a pair of tool beds, on which several tool holders are disposed for displacement by means of a threaded spindle. The tool holders each support a tool. The number of tool holders exceeds the number of threaded spindles. Each tool holder has a spindle nut, which is disposed on the threaded spindle and is mounted rotatably in the tool holder. It can be non-rotatably coupled with the tool holder by means of a clutch.

24 Claims, 7 Drawing Sheets

MACHINE FOR THE LENGTHWISE TREATMENT OF WEBS OF CORRUGATED BOARD

BACKGROUND OF THE INVENTION

1. Field of the Invention

The invention relates to a machine for the lengthwise treatment of webs of corrugated board, which is regularly a lengthwise cutting and/or grooving machine.

2. Background Art

In machines of the generic type known from U.S. Pat. No. 4,976,676 and U.S. Pat. No. 6,071,222, tool beds are housed by twos in a machine frame and can be moved toward, and away from, each other by means of suitable drives. Tool holders are disposed on the tool beds, which are allocated to each other by twos and which are displaceable crosswise of the conveying direction of a web of corrugated board that is passed between them. Each pair of tool holders holds a pair of tools consisting of a tool and a counterpart tool, which may be grooving tools or cutters. The tool holders are displaceable between lateral parking spaces and a working area located therebetween, the working area corresponding to the greatest possible width of the web of corrugated board to be treated. In the at least one lateral parking space, the tool holders, which include the tools and counterpart tools, are parked when not in use. This known design of lengthwise treatment machines can be used also within the scope of the invention. For displacement of the tool holders from the at least one parking space into the working area, threaded spindles are provided, with a spindle being allotted to each tool holder. A spindle nut is non-rotatably disposed in each tool holder so that, upon rotary actuation of the threaded spindle that is allotted to the respective tool holder, the tool holder is displaced on the corresponding tool bed crosswise of the conveying direction of the web of corrugated board either into its operating position in the working area or out of it into the associated parking space or, within the working area, from one operating position into another. Each threaded spindle has an actuation of its own. This design is very reliable and works very rapidly; however, it is complicated in construction and thus rather costly.

SUMMARY OF THE INVENTION

It is an object of the invention to embody a machine for the lengthwise treatment of webs of corrugated board of the type mentioned at the outset such that the constructional requirements of crosswise tool holder displacement are reduced.

According to the invention, this object is attained in a machine for lengthwise treatment of webs of corrugated board, comprising a machine frame; a first tool bed, which is movable from a position of rest into a working position and back again; at least one threaded spindle, which is disposed in the first tool bed and which is rotatably drivable; several tool holders, which are disposed on the first tool bed on a first side of a web of corrugated board and supported for displacement crosswise of the conveying direction of the web of corrugated board, and which have a tool, and the number of which exceeds the number of the threaded spindles, and which have a spindle nut, which is disposed on the threaded spindle, and which is rotatably mounted in the tool holder; a supporting arrangement for the web of corrugated board disposed on a second side of the web of corrugated board; and a clutch, by means of which to couple the spindle nut non-rotatably with the tool holder. This gist of the invention resides in that several tool holders are drivable by a single threaded spindle and that the respective tool holders may be selectively coupled with the threaded spindle.

There are several possibilities of supporting the web of corrugated board on a side opposite the tools. For instance, a rotatable, circular cylindrical brush that extends substantially over the full width of the web of corrugated board may be used as a support arrangement, which is known from EP 0 443 396 B1. Use may also be made of counterpart tools that are allocated to the tools and are disposed for crosswise displacement on a tool bed in the same way as the tools.

Further features, advantages and details of the invention will become apparent from the ensuing description of two exemplary embodiments, taken in conjunction with the drawing.

DESCRIPTION OF THE PREFERRED EMBODIMENTS

Figure 1:
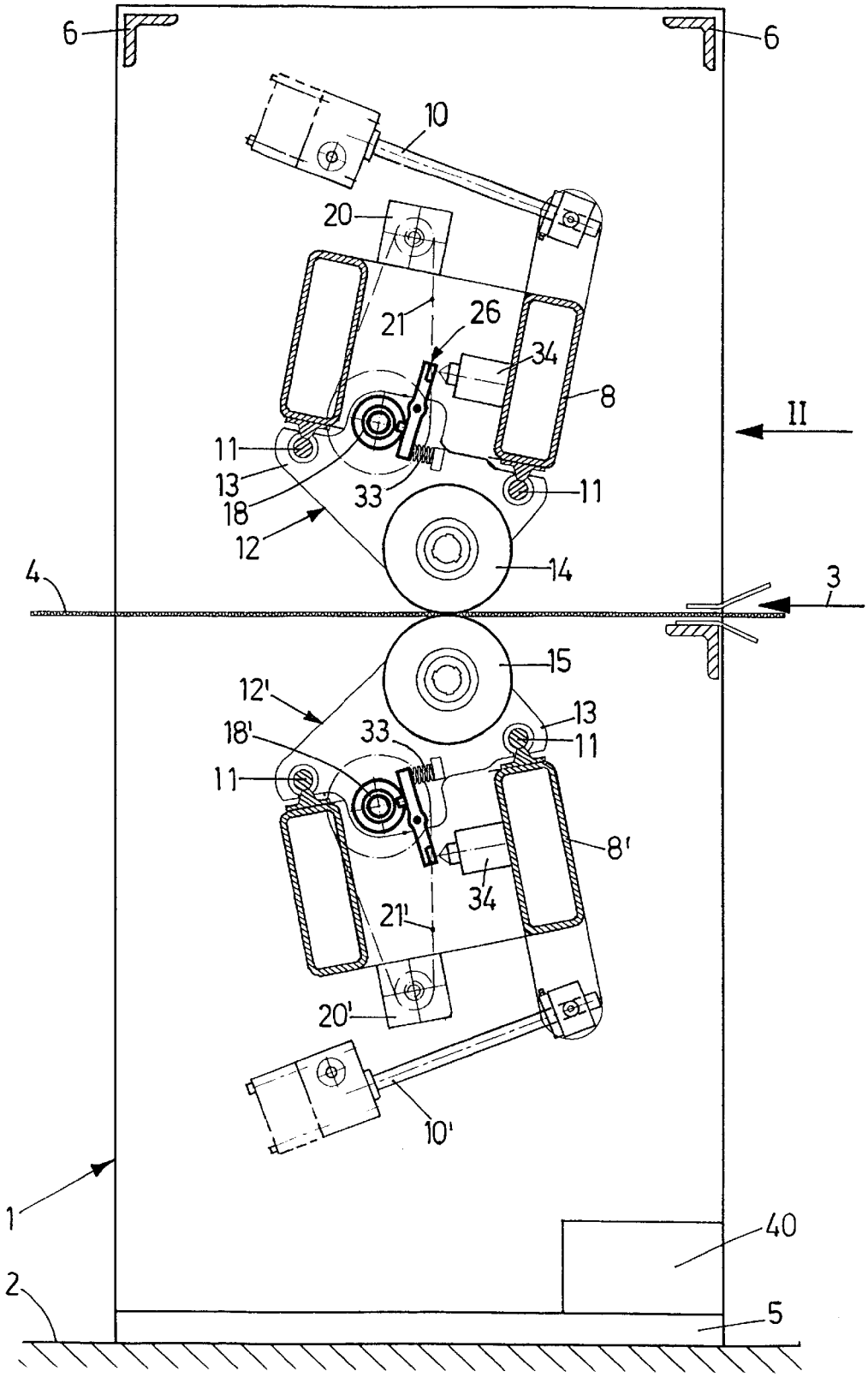
FIG. 1 is a vertical cross-sectional view through a first embodiment of a machine according to the invention on the line I—I of FIG. 2.
Figure 2:
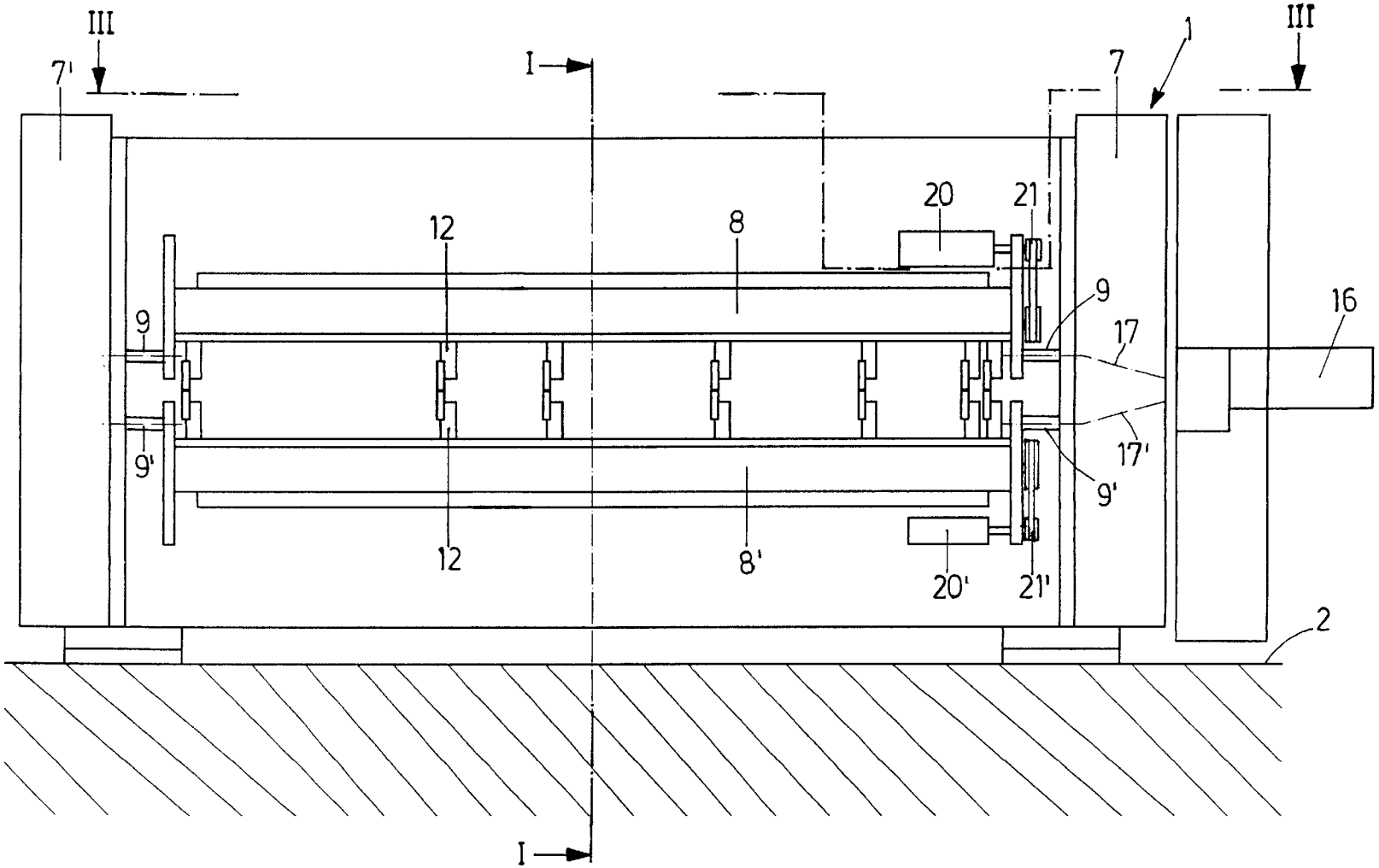
FIG. 2 is a lateral view of the machine in accordance with the arrow II of FIG. 1.
Figure 3:
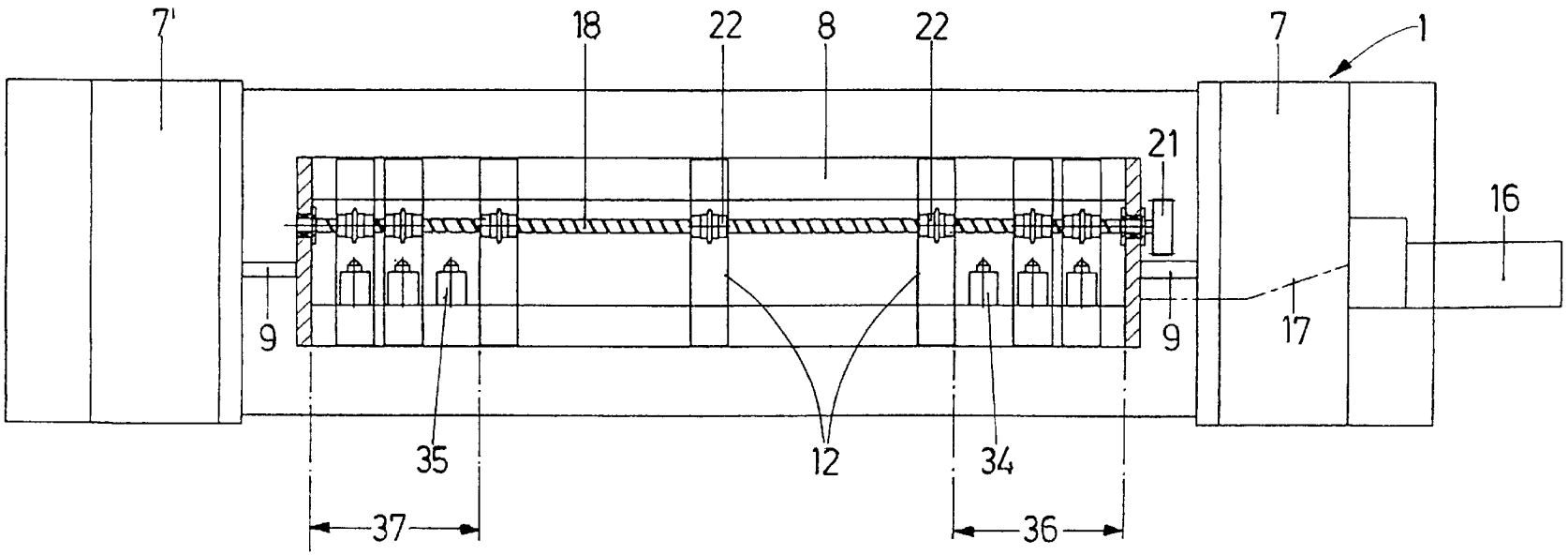
FIG. 3 is a plan view of the machine in accordance with the line III—III of FIG. 2.

The lengthwise cutting and grooving machine seen in the drawing comprises a machine frame 1 which is substantially stationary and which supports itself on the ground 2 by way of a horizontal, transverse follow-up device 5 that is oriented crosswise of the conveying direction 3 of a web of corrugated board 4. The machine frame 1 has lengthwise beams 6 which are horizontal and transverse to the conveying direction 3 and which are joined to each other at their ends by side walls 7, 7'.

In the machine frame 1, namely between the side walls 7, 7', a pair of tool beds 8, 8' is lodged pivotably about a pivot axis 9, 9'. The tool beds 8, 8' are disposed one above the other approximately in mirror symmetry to the web of corrugated board 4 they accommodate between them. The pivot axes 9, 9' are housed in the side walls 7, 7'. Pivoting about the pivot axes 9, 9' takes place by means of pivot drives 10, 10' in the form of spindle nut drives.

On the sides, turned toward the web of corrugated board 4, of the tool beds 8, 8', provision is made for guideways 11, on which tool holders 12, 12' that are again allocated to each other in pairs are supported for horizontal displacement crosswise of the conveying direction 3 by means of guide blocks 13. A tool 14 is rotatably mounted on the tool holders 12 that are disposed above the web of corrugated board 4; a counterpart tool 15 is allocated to the tool 14, which is rotatably mounted on the tool holder 12' and located below the web of corrugated board 4. The tools 14 and the counterpart tools 15 may be grooving tools for the production of longitudinal grooving in the conveying direction 3 in the web of corrugated board 4 or they may be cutters for lengthwise cutting the web of corrugated board 4 in the conveying direction 3. Grooving tools and cutters of the species and the actuation thereof are known from U.S. Pat. No. 6,071,222. Rotary actuation of the tools 14 and counterpart tools 15 takes place via an articulated shaft 17, 17' by means of a driving motor 16 that is mounted on the side walls 7, 7'. If the tools 14 are rotating cutters, the counterpart tools 15 may be counterpart holding tables, which is also known from the above publications.

By means of the pivot drives 10, 10', the tools 14 and counterpart tools 15 may be moved into a position of engagement seen in FIG. 1 with grooving or a longitudinal cut being produced by each pair of tools 14 and counterpart tools 15 in the web of corrugated board 4 that is transported in the conveying direction 3. The tools 14 and counterpart tools 15 are pivotable into a position (not shown) of disengagement from the web of corrugated board 4.

Figure 4:
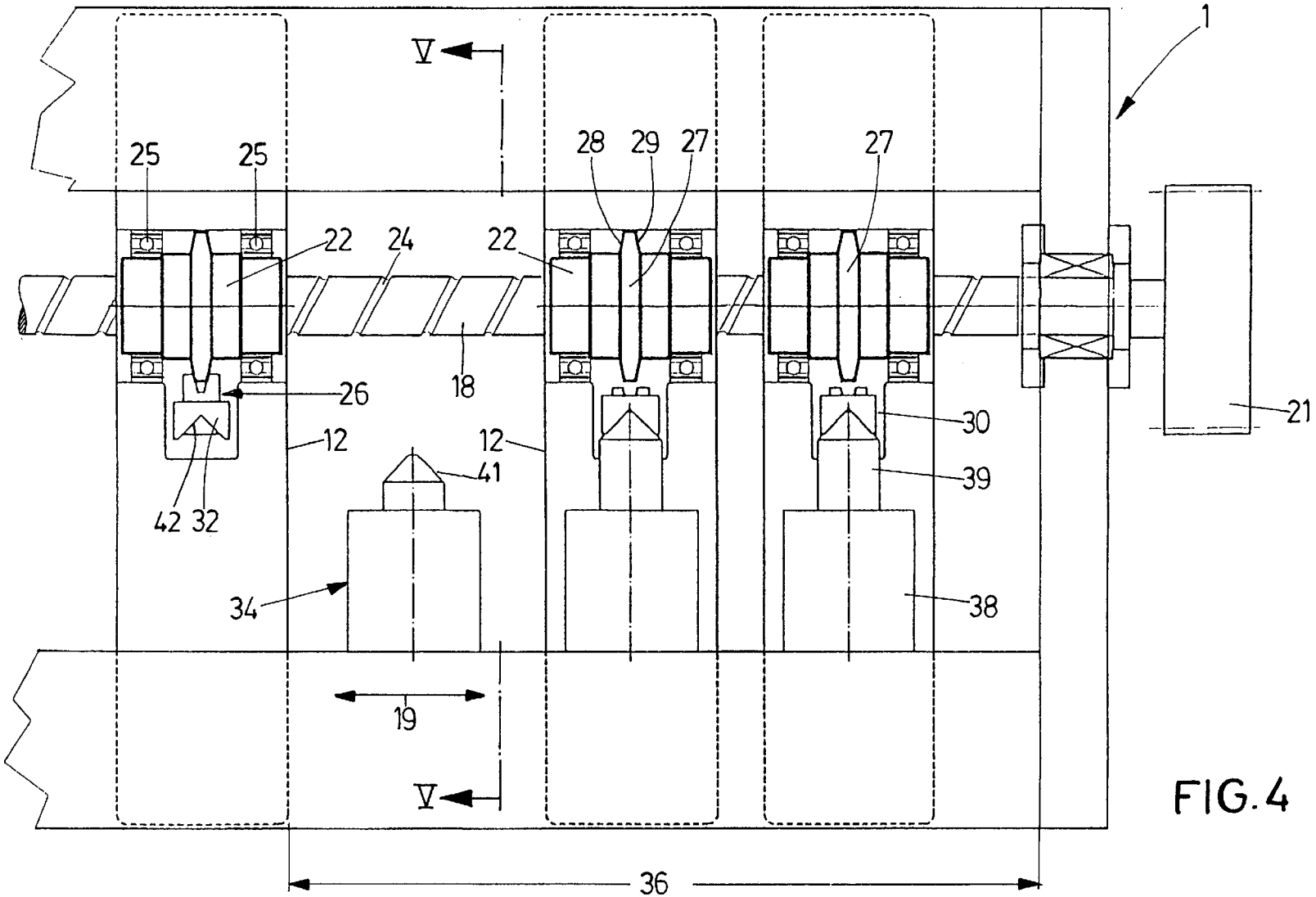
FIG. 4 is a partial plan view of the machine on an enlarged scale as compared to FIG. 3.

In the exemplary embodiment seen in FIGS. 1 to 5, all the tool holders 12 lodged in the tool bed 8 and all the tool holders 12' displaceably lodged in the tool bed 8' are displaced and positioned horizontally and crosswise of the conveying direction 3 in the direction of transverse displacement 19 by means of a threaded spindle 18 and 18' as a setting shaft that is rotatably lodged in the respective tool bed 8, 8*a*. Actuation of these spindles 18, 18' takes place via a synchronous belt drive 21, 21' by way of a servomotor 20, 20' mounted on the tool bed 8 and 8'. Each tool holder 12, 12' comprises a spindle nut 22 that is disposed on the spindle 18, 18' and the internal thread 23 of which engages with the external thread 24 of the respective spindle 18 and 18'. By means of ball bearings 25, the spindle nut 22 is lodged freely rotatably in each tool holder 12, 12', but—as seen in FIG. 4—it is fixed in the direction of transverse displacement 19. Provided on each tool holder 12, 12' is a clutch 26 by means of which the free rotatability of the spindle nut 2 in relation to the tool holder 12, 12' may be precluded i.e., by means of which the spindle nut 22 may be non-rotatably connected with the respective tool holder 12, 12'. In the embodiment shown, the clutch 26 is a clamp and friction clutch. Disposed between the bearings 25 on the outer circumference of the spindle nut 22 is a clamp and friction ring 27 which is united therewith in a single piece or at least tightly and which has two clamp and friction surfaces 28, 29 extending slightly conically toward each other—as seen in FIG. 4. In the tool holder, a clutch lever 30 is allocated to the ring 27 and the surfaces 28, 29; it is mounted in the respective tool holder 12 and 12' for pivoting about an axis 31 that runs in the direction 19 of transverse displacement. The clutch lever 30 has a clamp and friction jaw 32 that is suited to the ring 27 and the surfaces 28, 29. At an end turned toward the jaw 32, the two-armed lever 30 is actuated by force in the direction toward the spindle nut 22 by means of a prestressed compression spring 33 so that—if no force is exercised on the lever 30, acting counter to the spring 33—the clamp and friction jaw 32 firmly houses the clamp and friction surfaces 28, 29 within itself, uniting the spindle nut 22 non-rotatably with the respective tool holder 12 and 12'.

Upon actuation of the threaded spindle 18 and 18' by means of the respective servomotor 20, 20', all the tool holders 12, 12' which the spindle nuts 22 are non-rotatably coupled with are displaced in the direction of transverse displacement 19, depending on the direction of rotation of the spindle 18 and 18', whereas all the tool holders 12, 12' that are not connected with the respective spindle nut 22 non-rotatably remain in their position of rest on the respective tool bed 8 and 8'.

Figure 5:
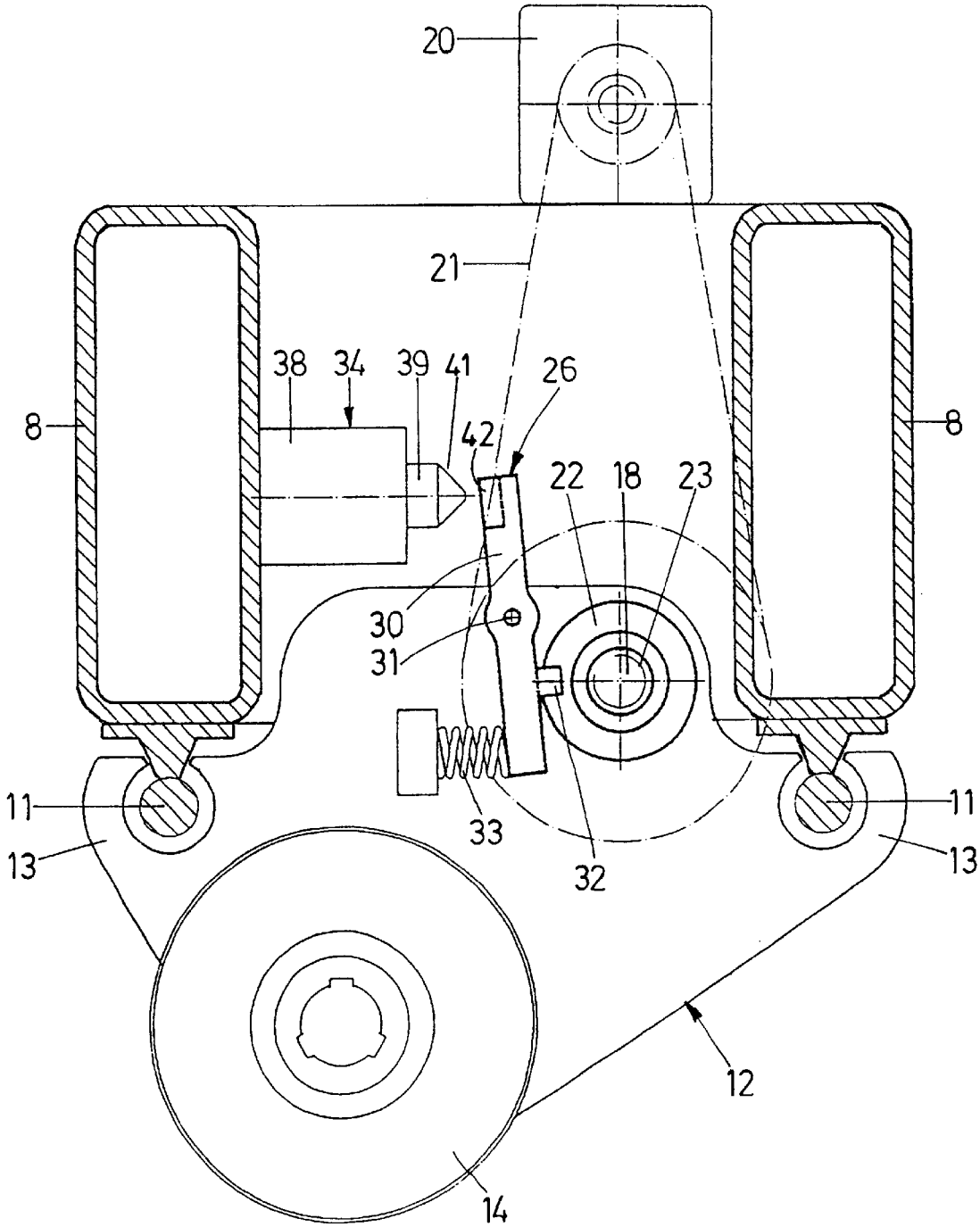
FIG. 5 is a partial cross-sectional view through the machine in accordance with the line V—V of FIG. 4.

Opening and releasing the clutch 26 takes place by means of disengaging drives 34, 35 which are disposed on the two end portions, neighboring the side walls 7, 7', of the tool beds 8, 8'. These end portions constitute parking spaces 36, 37 for tool holders 12, 12' equipped with tools 14 and counterpart tools 15 that are not in use. Disposed in these parking spaces 36, 37 are a number of disengaging drives 34, 35 corresponding to the number of tool holders 12 and 12'. The disengaging drives 34, 35 mounted on the tool beds 8, 8' are fluid actuated, in particular pneumatically actuated piston-cylinder drives, the cylinders 38 of which are mounted on the tool bed 8, 8_and the piston rod 39 of which may bear against the lever on the end thereof that is opposite the spring 33 and the jaw 32. Upon actuation of the cylinder 38 and upon extraction, resulting therefrom, of the piston rod 39 out the cylinder 38, the lever 30 is pivoted counter to the direction of force of the spring 33 so that the clutch 26 is released; the spindle nut 22 of the corresponding tool holder 12, 12' is again freely rotatable relative to the tool holder 12, 12'. In FIGS. 1 and 5, the piston rod 39 is shown in the retracted condition; the spindle nut 22 is tightly united with the tool holder 12. By contrast, FIG. 4 illustrates some extracted piston rods 39, i.e. disengaged clutches 26.

Controlling the clutches 26, namely the disengaging drives 34, 35, takes place via a control system 40, by way of which are triggered the solenoid valves (not shown separately) which are integrated in the disengaging drives 34, 35. The control system 40 is program-controlled i.e., upon input of a certain format, displacement and positioning of the tool holders 12, 12' with the tools 14 and counterpart tools 15 takes place in a program-generated sequence. Fundamentally, attention must be paid to the problem that all the tool holders 12 and 12' that are coupled with the respective spindle 18, 18' are displaced upon rotations of the respective spindle 18, 18'. This means that the tool holders 12, 12' are not moved in pairs one after the other into their final working position, but that they are coupled with the spindle 18 and 18' in such a way that, at the end of rotary actuation of the respective spindle 18, 18', they are all moved simultaneously into their final working position.

Figure 6:
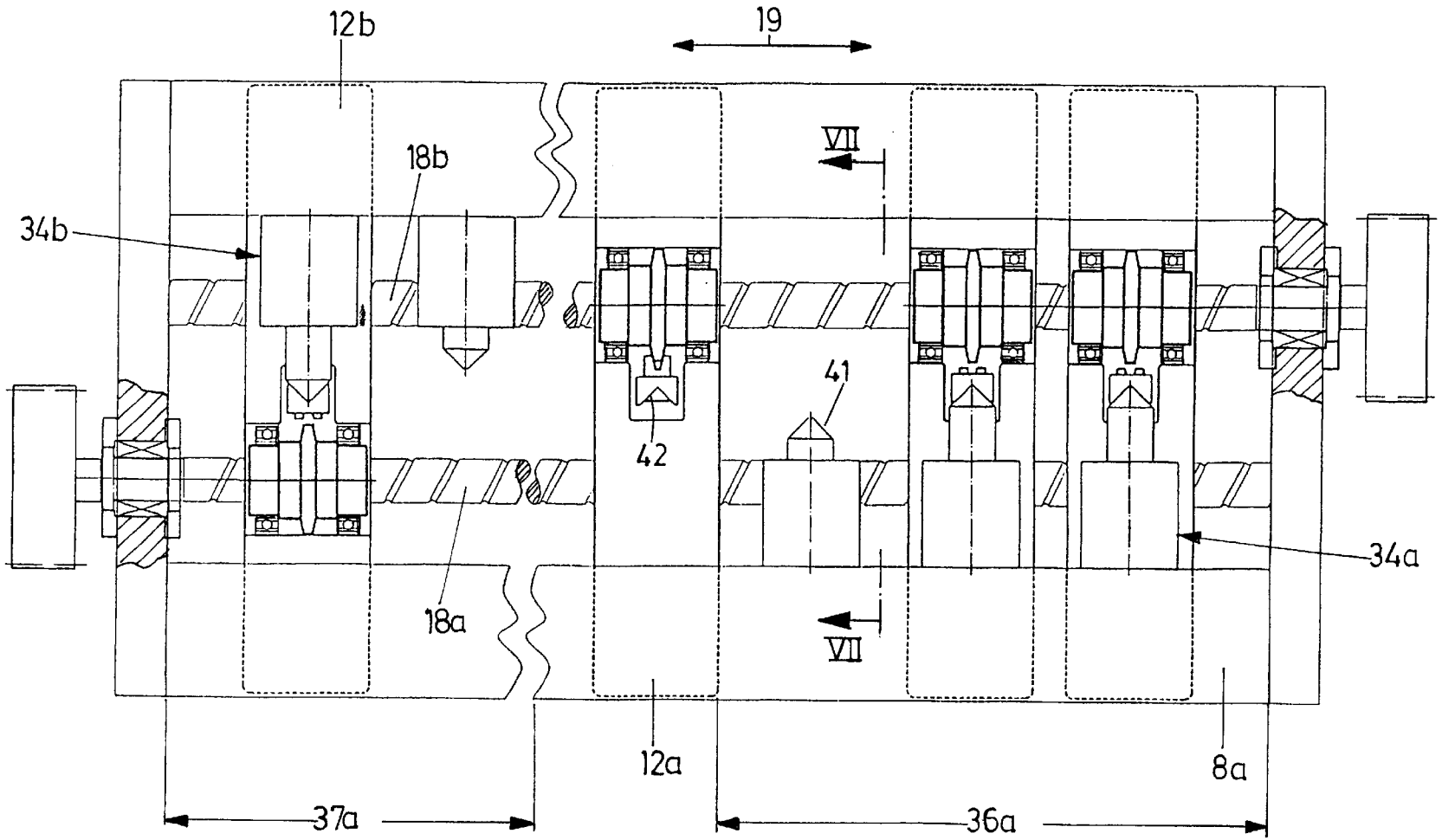
FIG. 6 is a plan view of a second exemplary embodiment of a machine according to the invention.
Figure 7:
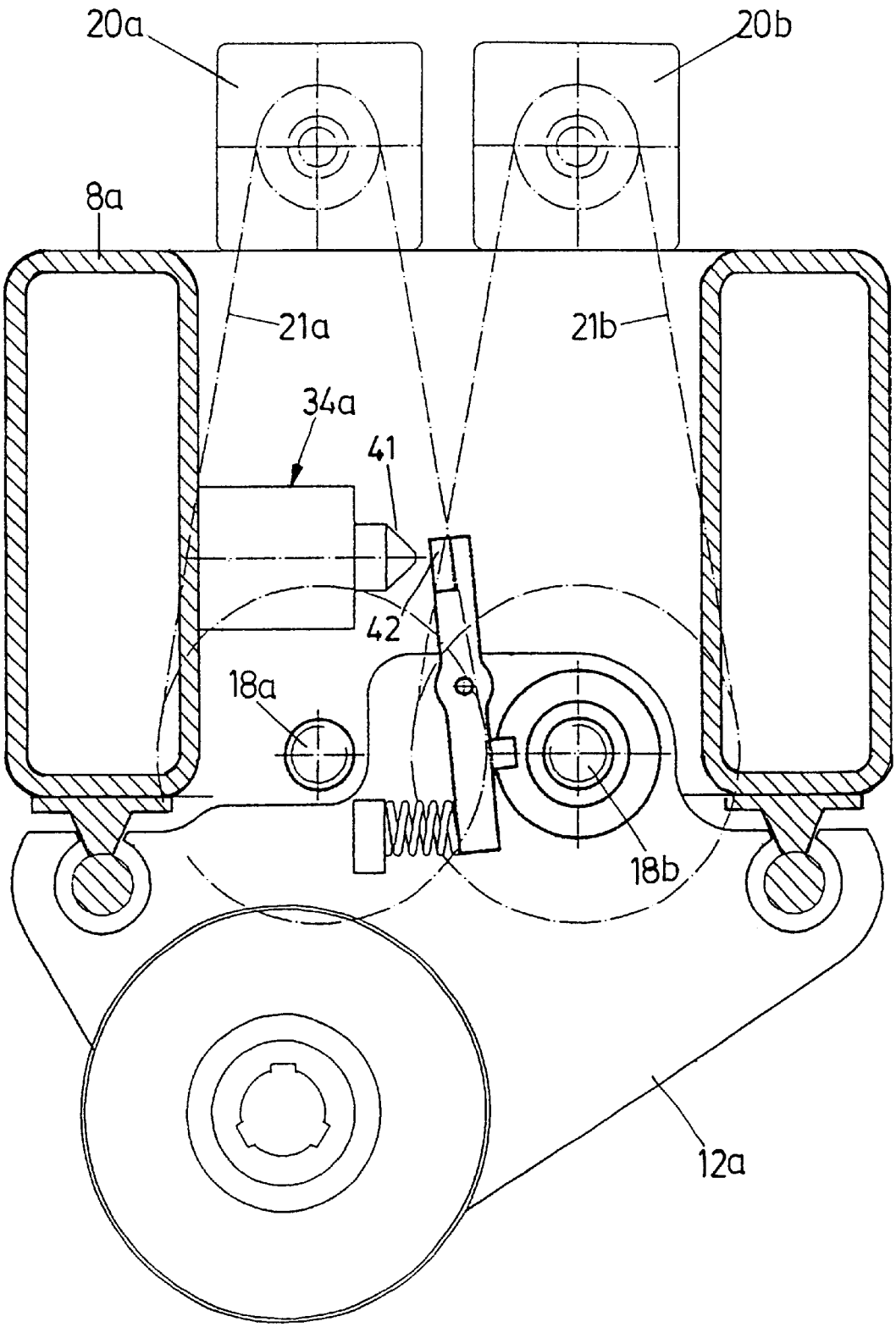
FIG. 7 is a partial cross-sectional view through the second embodiment of the machine in accordance with the line VII—VII of FIG. 6.

FIGS. 6 and 7 show a second exemplary embodiment of the invention in an illustration that corresponds approximately to FIGS. 4 and 5.

In this case, tool holders 12*a* are displaceably guided in the respective tool bed 8*a* with two spindles 18*a* and 18*b* lodging in each tool bed 8*a*, which are drivable independently of each other via synchronous belt drives 21*a*, 21*b* by means of servomotors 20*a*, 20*b*. Part of the tool holders 12*a*, for instance half of them, can be coupled with the spindle 18*a*, while the other part, for example the other half, of the tool holders 12*b* can be coupled with the other spindle 18*b*. Correspondingly, only the disengaging drives 34*a* that are allocated to the tool holders 12*a* are disposed in the parking space 36*a*, whereas the disengaging drives 34*b* that are allocated to the tool holders 12*b* are disposed in the parking space 37*a*. The tool holders 12*a* and 12*b* are per se identical with the tool holders 12 of the embodiment according to FIGS. 1 to 5; they are arranged one relative to the other, mirrored about a vertical axis. The same is true for the disengaging drives 34*a* and 34*b* in relation to the disengaging drives 34. FIGS. 6 and 7 only show the upper part of the machine. The lower part is to be understood by analogy.

In all the embodiments it is ensured that the tool holders 12, 12', 12*a*, 12*b*, are being positioned on the associated disengaging drive 34, 34*a*, 34*b* in their respective position of rest in the parking space 36, 37, 36*a*, 37*a*, which means that they are moved into an accurate zero position prior to each renewed displacement. To this end, a prismatic wedge 41 is mounted on the piston rod 39 of each disengaging drive 34, 34*a*, 34*b* and a precisely suited prismatic recess is provided on the clutch lever 30 so that, upon engagement of the wedge 41 with the associated recess 42, the associated tool holder 12, 12', 12*a*, 12*b* is moved into a position that is precisely allocated to the stationary disengaging drive 34, 34*a*, 34*b* i.e., a position of rest.

Generally it can be said that the number of threaded spindles 18, 18', 18*a*, 18*b* per tool bed 8, 8', 8*a* should not be more than four and maximally two. At least two tool holders 12, 12', 12*a*, 12*b* are allocated to each threaded spindle 18, 18', 18*a*, 18*b*.

What is claimed is:

1. A machine for lengthwise treatment of webs of corrugated board, comprising a machine frame (1);

a first tool bed (8, 8', 8*a*), which is movable from a position of rest into a working position and back again;

at least one threaded spindle (18, 18', 18*a*, 18*b*), which is disposed in the first tool bed (8, 8', 8*a*) and which is rotatably drivable;

several tool holders (12, 12', 12*a*, 12*b*),— which are disposed on the first tool bed (8, 8', 8*a*) on a first side of a web of corrugated board (4) and supported for displacement crosswise of a conveying direction (3) of the web of corrugated board (4), which have a tool (14),— the number of which exceeds the number of the at least one threaded spindle (18, 18', 18*a*, 18*b*), and which have a spindle nut (22), which is disposed on the threaded spindle (18, 18*a*, 18*b*), and which is rotatably mounted in the tool holder (12, 12', 12*a*, 12*b*)

a supporting arrangement for the web of corrugated board (4) disposed on a second side of the web of corrugated board (4); and a clutch (26), by means of which to couple the spindle nut (22) non-rotatably with the tool holder (12, 12', 12*a*, 12*b*);

wherein disengaging drives for releasing the clutches (26) are mounted on the first tool bed;

wherein the disengaging drives are disposed in at least one parking space of the first tool bed that is disposed laterally of the web of corrugated board (4).

2. A machine for lengthwise treatment according to claim 1, wherein a second tool bed (8') is disposed on a second side of the web of corrugated board (4), forming a pair with the first tool bed (8, 8*a*, 8*b*).

3. A machine for lengthwise treatment according to claim 2, wherein tool holders (12') are disposed on the second tool bed (8'), which are allocated in pairs to the tool holders (12, 12*a*, 12*b*) of the first tool bed (8, 8*a*, 8*b*) and have a counterpart tool (15).

4. A machine for lengthwise treatment according to claim 2, wherein maximally four threaded spindles (18, 18') are disposed in the first and the second tool bed (8, 8', 8*a*).

5. A machine for lengthwise treatment according to claim 4, wherein maximally two threaded spindles (18*a*, 18*b*) are disposed in the first and the second tool bed (8*a*).

6. A machine for lengthwise treatment according to claim 4, wherein tool holders (12, 12', 12*a*, 12*b*) are disposed on the first and the second tool bed (8, 8', 8*a*, 8*b*) in a number which is at least twice the number of threaded spindles (18, 18', 18*a*, 18*b*).

7. A machine for lengthwise treatment according to claim 2, wherein disengaging drives for releasing the clutches (26) are also mounted on the second tool bed.

8. A machine for lengthwise treatment according to claim 7, wherein the disengaging drives are also disposed in at least one parking space of the second tool bed that is disposed laterally of the web of corrugated board (4).

9. A machine for lengthwise treatment according to claim 7, wherein the disengaging drives (34, 35, 34*a*, 34*b*) are provided with arrangements for accurately positioning the tool holders (12, 12', 12*a*, 12*b*).

10. A machine for lengthwise treatment according to claim 7, wherein the disengaging drives are also disposed in at least one parking space of the second tool bed that is disposed laterally of the web of corrugated board (4).

11. A machine for lengthwise treatment according to claim 1, wherein the clutch (26) is a clamp and friction clutch acting between the spindle nut (22) and the tool holder (12, 12', 12*a*, 12*b*).

12. A machine for lengthwise treatment according to claim 1, wherein allocated to each threaded spindle (18, 18', 18*a*, 18*b*) is a servomotor (20, 20', 20*a*, 20*b*) of its own.

13. A machine for lengthwise treatment according to claim 12, wherein the spindle nut (22) is provided with a clamp and friction ring (27), to which is allocated a clutch lever (30) which is pivotably lodged in the tool holder (12, 12', 12*a*, 12*b*) and has a clamp and friction jaw (32).

14. A machine for lengthwise treatment according to claim 13, wherein the clamp and friction jaw (32) is suited to clamp and friction surfaces (28, 29) formed on the clamp and friction ring (27).

15. A machine for lengthwise treatment according to claim 13, wherein the clutch lever (30) is loaded by an energy storing device (33) which forces the clutch lever (30) into a clutching position.

16. A machine for lengthwise treatment of webs of corrugated board, comprising a machine frame (1);

a first tool bed (8, 8', 8*a*), which is movable from a position of rest into a working position and back again;

at least one threaded spindle (18, 18', 18*a*, 18*b*), which is disposed in the first tool bed (8, 8', 8*a*) and which is rotatably drivable;

several tool holders (12, 12', 12*a*, 12*b*), which are disposed on the first tool bed (8, 8', 8*a*) on a first side of a web of corrugated board (4) and supported for displacement crosswise of a conveying direction (3) of the web of corrugated board (4), which have a tool (14), the number of which exceeds the number of the at least one threaded spindle (18, 18', 18*a*, 18*b*), and which have a spindle nut (22), which is disposed on the threaded spindle (18, 18*a*, 18*b*), and which is rotatably mounted in the tool holder (12, 12', 12*a*, 12*b*);

a supporting arrangement for the web of corrugated board (4) disposed on a second side of the web of corrugated board (4); and a clutch (26), by means of which to couple the spindle nut (22) non-rotatably with the tool holder (12, 12', 12*a*, 12*b*);

wherein disengaging drives for releasing the clutches (26) are mounted on the first tool bed;

wherein the disengaging drives are disposed in at least one parking space of the first tool bed that is disposed laterally of the web of corrugated board (4); and wherein the disengaging drives are provided with arrangement for accurately positioning the tool holders by which said arrangements the tool holders are moved into an accurate zero position prior to each renewal displacement.

17. A machine for lengthwise treatment according to claim 16, wherein a second tool bed (8') is disposed on a second side of the web of corrugated board (4), forming a pair with the first tool bed (8, 8*a*, 8*b*).

18. A machine for lengthwise treatment according to claim 17, wherein tool holders (12') are disposed on the second tool bed (8'), which are allocated in pairs to the tool holders (12, 12*a*, 12*b*) of the first tool bed (8, 8*a*, 8*b*) and have a counterpart tool (15).

19. A machine for lengthwise treatment according to claim 17, wherein disengaging drives for releasing the clutches (26) are also mounted on the second tool bed.

20. A machine for lengthwise treatment according to claim 16, wherein allocated to each threaded spindle (18, 18', 18*a*, 18*b*) is a servomotor (20, 20', 20*a*, 20*b*) of its own.

21. A machine for lengthwise treatment according to claim 16, wherein the clutch (26) is a clamp and friction clutch acting between the spindle nut (22) and the tool holder (12, 12', 12*a*, 12*b*).

22. A machine for lengthwise treatment according to claim 21, wherein the spindle nut (22) is provided with a clamp and friction ring (27), to which is allocated a clutch lever (30) which is pivotably lodged in the tool holder (12, 12', 12*a*, 12*b*) and has a clamp and friction jaw (32).

23. A machine for lengthwise treatment according to claim 22, wherein the clamp and friction jaw (32) is suited to clamp and friction surfaces (28, 29) formed on the clamp and friction ring (27).

24. A machine for lengthwise treatment according to claim 22, wherein the clutch lever (30) is loaded by an energy storing device (33) which forces the clutch lever (30) into a clutching position.

* * * * *